United States Patent [19]

Kusakawa et al.

[11] Patent Number: 4,790,368

[45] Date of Patent: Dec. 13, 1988

[54] METHOD OF MANUFACTURING THIN METAL SHEET DIRECTLY FROM MOLTEN METAL AND APPARATUS FOR MANUFACTURING SAME

[75] Inventors: Takaji Kusakawa, Tokyo; Kazuo Ebato, Kanagawa; Takeya Tohge, Kanagawa; Masato Noda, Kanagawa; Yasuhide Kuroda, Kanagawa, all of Japan

[73] Assignees: Nippon Yakin Kogyo Co. Ltd.; Talako Kusakawa, both of Tokyo, Japan

[21] Appl. No.: 89,913

[22] Filed: Aug. 24, 1987

Related U.S. Application Data

[63] Continuation of Ser. No. 891,881, Jul. 31, 1986, abandoned.

[30] Foreign Application Priority Data

Aug. 13, 1985 [JP] Japan ..... 60-176906

[51] Int. Cl.[4] ..... B22D 11/06; B22D 11/10

[52] U.S. Cl. ..... 164/480; 164/428; 164/437; 164/489

[58] Field of Search ..... 164/428, 480, 437, 488, 164/489; 222/593

[56] References Cited

U.S. PATENT DOCUMENTS

| | | | |
|---|---|---|---|
| 2,332,759 | 10/1943 | Schwarz | 164/428 |
| 3,604,598 | 9/1971 | Kappmeyer et al. | 222/593 |
| 3,867,978 | 2/1975 | Johansson et al. | 164/437 |

FOREIGN PATENT DOCUMENTS

| | | | |
|---|---|---|---|
| 54-8162 | 1/1979 | Japan . | |
| 55-176085 | 12/1980 | Japan . | |
| 58-151948 | 9/1983 | Japan | 164/488 |
| 58-238736 | 12/1983 | Japan . | |
| 60-21171 | 2/1985 | Japan | 164/428 |
| 60-21158 | 2/1985 | Japan | 164/437 |
| 60-21153 | 2/1985 | Japan | 164/437 |

OTHER PUBLICATIONS

Journal of the Iron and Steel Institute of Japan, No. 14, Volume 68, Oct. 1982, Pages, 74–82.

*Primary Examiner*—M. Jordan
*Assistant Examiner*—Richard K. Seidel
*Attorney, Agent, or Firm*—Balogh, Osann, Kramer, Dvorak, Genova & Traub

[57] ABSTRACT

A wide thin metal sheet having a smooth surface may be manufactured directly from molten metal. A lower end of a nozzle installed vertically at the bottom of a molten metal vessel is held in contact with an inclined plate made of a refractory material, molten metal is discharged in a fan-shape from a notch formed in the peripheral wall of the nozzle end, the discharged molten metal being rendered into a constant shape laminar flow having a uniform flow rate distribution on the inclined surface as it flows down the inclined plate. The constant shape laminar flow is supplied to a molten metal pool between a pair of rollers of internally water-cooled type without any disturbance on the surface and in the inside. The metal solidified in the neighborhood of a portion of the gap between the two rollers is discharged from an open-at-the-bottom space defined between the two rollers.

12 Claims, 10 Drawing Sheets

METHOD OF MANUFACTURING THIN METAL SHEET DIRECTLY FROM MOLTEN METAL AND APPARATUS FOR MANUFACTURING SAME

This application is a continuation of application Ser. No. 891,881 filed July 31, 1986 now abandoned.

BACKGROUND OF THE INVENTION

1. Field of the Invention

This invention relates to a method of manufacturing a thin metal sheet directly from molten metal and an apparatus for manufacturing the same and, more particularly, to a method of manufacturing a thin metal sheet having an excellent surface character by continuously supplying a laminar flow having a constant shape of molten metal to a space between a pair of rollers and an apparatus for manufacturing the same.

2. Description of the Prior Art

Various methods and apparatuses for manufacturing a thin metal sheet directly from molten metal using a pair of rollers have been proposed.

For example, Japanese Patent Publication No. Sho 60-11584 discloses a continuous casting equipment, in which a gutter body is provided inclinedly, a molten metal inlet is provided at a higher level end of the gutter body, a dam or barrage for retaining charged molten metal is provided near the higher level end of the gutter body, a molten metal overflow section is provided adjacent to the lower level end of the gutter body, a cooling system for adequately cooling the molten metal flowing along the gutter body is provided, a mold consisting of a pair of rollers is provided at a suitable position below the molten metal overflow section, the higher level end of the gutter body is rotatably coupled by a pin to a stationary member, and a piston-and-cylinder assembly for turning the gutter body upwards and downwards about the pin is provided. Japanese Patent Laid-open No. Sho 55-100850 discloses a method of manufacturing an amorphous metal sheet by supplying molten metal onto the surface of a quick solidification roller or into a space between rollers for solidification, in which molten metal issuing from a nozzle is caused to strike an end portion of a base member having a flat or curved surface and then rendered into a molten metal flow having a predetermined flow width which is continuously supplied to the roller or rollers. Japanese Patent Laid-open No. Sho 60-130455 discloses a method of manufacturing a quickly cooled thin metal sheet by supplying molten metal from a nozzle toward the periphery of a high thermal conductivity material roller rotating at a high speed and solidifying the supplied molten metal by removal of heat due to contact with the roller to thereby obtain the thin metal sheet, in which the supplied flow of molten metal is rendered into a wide thin laminar flow before being fed to the roller periphery with a flat relay guide of a heat-resisting material provided between the nozzle and the roller for causing a slight deflection of the supplied molten metal flow.

With the continuous casting equipment disclosed in Japanese Patent Publication No. Sho 60-11584, it is difficult to control the flow rate. If the flow rate is insufficient, a phenomenon of narrowing the shape of flow even if charged a metal laminar flow having a width of a water-cooled roller readily occurs due to the surface tension. Further, the impact force of the flow is locally concentrated in a molten metal pool between water-cooled rollers. Therefore, there occur great variations of the molten metal level and resultant great disturbances of the molten metal flow. Consequently, a large number of wrinkles are formed on the surface of the obtained thin metal sheet. Further, the temperature distribution of the thin metal sheet immediately after emerging from the discharged rollers is not uniform. Therefore, cracks are inevitably formed in portions at high temperature. Further, with a prior art method of manufacturing an amorphous alloy, it has been difficult to manufacture a metal sheet having a large width. In the Japanese Patent Laid-open No. Sho 55-100850 noted above, it is disclosed that a wide metal sheet may be obtained by causing molten metal flow issued from a nozzle to strike an end portion of a base platen to form a wide molten metal flow and then quickly solidifying the molten metal by means of the roller. This method, however, has a problem that it is impossible to manufacture a very thin amorphous metal sheet with a thickness of 30 μm and a width of 30 mm, for instance.

According to the invention disclosed in the Japanese Patent Laid-open No. Sho 60-130455 noted above, molten metal is supplied toward the roller periphery to the nozzle. Therefore, when the molten metal strikes the roller periphery, it is partly spattered to be attached to and solidified on the surface of a quickly cooled thin metal sheet being manufactured. Therefore, the surface smoothness of the thin metal sheet is insufficient.

An object of the present invention is to provide a method and an apparatus, which may preclude or overcome the various problems discussed above inherent in the prior art.

SUMMARY OF THE INVENTION

According to the present invention, a wide thin metal sheet may be manufactured directly from molten metal by a method, in which a lower end of a nozzle installed vertically at the bottom of a molten metal vessel is held in contact with an inclined surface of an inclined plate of a refractory material, the molten metal is caused to be discharged in a fan-shape from a notch formed in the peripheral wall of the nozzle, the notch facing the lower level end of the inclined plate, the discharged molten metal being rendered into a constant shape laminar flow having a uniform flow rate distribution on the inclined surface as it flows down the inclined plate, the constant shape laminar flow is supplied continuously and in an impact-free fashion to an open-at-the-top surface defined between a pair of rollers of internally water-cooled type disposed in the neighborhood of the lower level end of the inclined plate and having axes of rotation extending substantially parallel to the lower level end, thereby forming a molten metal pool without any disturbance on the surface and in the inside, and the molten metal is solidified in the neighborhood of a portion of the gap between the two rollers where the two rollers are closest to each other, the solidified metal being discharged from an open-at-the-bottom space defined between the two rollers.

BRIEF DESCRIPTION OF THE DRAWINGS

FIG. 3(*b*) is a transversal sectional view taken along line A—A' in FIG. 3(*a*), showing the lower end of the nozzle;

FIG. 4(*b*) is a cross-sectional view in case when the pair rollers having different diameters are used in FIG. 4(*a*);

DETAILED DESCRIPTION OF THE INVENTION

Figure 1:
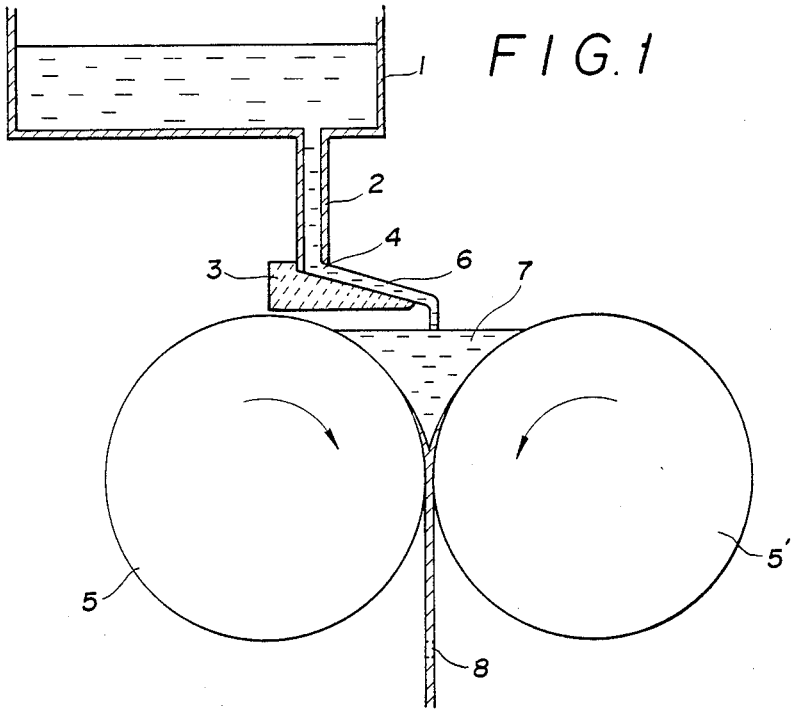
FIG. 1 is a longitudinal cross-sectional view showing an apparatus according to the present invention.

"Tetsu-to-Hagane" Vol. 68 (1982), page 1938 discloses that when water is allowed to fall from a nozzle onto a flat plate surface, a laminar flow is obtained, which is in the form of a thin liquid film radially spreading from the point of striking as the center in a certain area, and also it discloses flow characteristics of such laminar flows. The inventors of the present invention conducted, with reference to this literature, experiments of causing flows to fall from the lower end of a nozzle onto a higher level half portion of an inclined plate first using a mixture of glycerine and water with the viscosity and specific gravity made equal to those of molten steel and then using a similar mixture with only the viscosity made equal to that of the molten steel. The glycerine-water mixture striking the inclined plate was immediately disturbed, so that no laminar flow flowing down the inclined plate was formed.

Similar experients were conducted with a horizontal lower end of the nozzle in contact with the inclined plate. In this case, a laminar flow formed on the inclined plate was observed.

The above experiments were conducted with molten steel. In these experiments, the laminar flow could be obtained on the inclined plate surface like the case of the water-glycerine mixture. This laminar flow was supplied from the lower leven end of the inclined plate to an open-at-the-top space between the pair of rollers to form a molten metal pool so as to manufacture a thin metal sheet through quick cooling solidification. In this case, wrinkles and cracks were formed in portions of the thin metal sheet near the opposite edges. It was found as a result of study that this is due to lack of uniformity of the rate of flow of molten steel flowing down from the lower level end of the inclined plate, the flow rate being extremely high in opposite side zones compared to that in a central zone.

After extensive experiments, the inventors have found that part of the molten steel flow is directed toward the upper end of the inclined plate and then redirected toward the opposite sides of the inclined plate. Further, its direction is gradually changed to the downward direction as it flows down the inclined plate. Therefore, the flow rate distribution of the molten steel flow is extremely increased in opposite side portions of the molten steel flow.

To remove the cause of the lack of uniformity of the flow rate distribution, the inventors conducted experiments similar to those noted above by forming the lower end of the nozzle with a notch over a portion of the periphery corresponding to the downwardly inclined surface. As a result, a substantially uniform flow rate distribution of the laminar flow over the inclined plate could be obtained, and no substantial wrinkles were recognized on the surface of the thin metal sheet obtained. Further, the temperature distribution of the thin metal sheet immediately after being discharged from the rollers was very uniform, and no fine surface cracks were recognized.

The inventors conducted experiments using the method disclosed in the Japanese Patent Laid-open No. Sho 55100850. More specifically, they caused molten metal to strike an end portion of a base plate, then caused it to be supplied to an open-at-the-top space between two rollers to be quickly cooled down and solidified on the rotating surfaces of the two rollers and space therebetween so as to discharge the solidified metal from the open-at-the-bottom space between the two rollers. However, no thin metal sheet having satisfactory surface character could be obtained.

The present invention will now be described with reference to the drawings.

Figure 2:
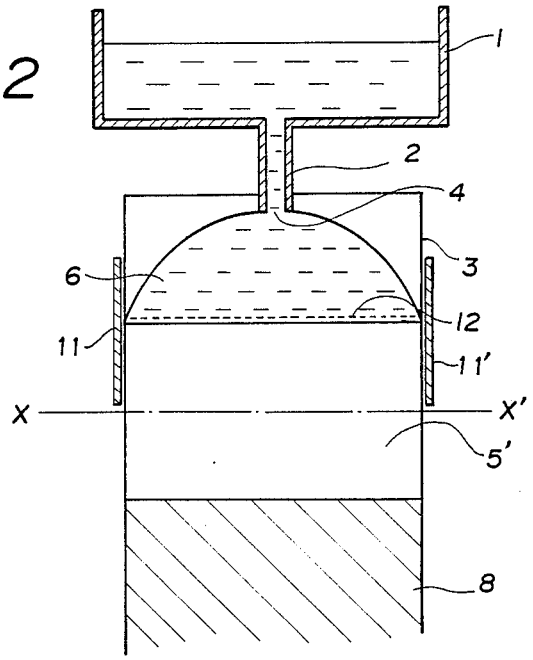
FIG. 2 is a front view, partly broken away, showing the apparatus shown in FIG. 1.

FIG. 1 is a sectional view showing an arrangement of an apparatus according to the present invention. The arrangement comprises a molten metal vessel 1, a nozzle 2 depending from the bottom of the vessel 1, an inclined plate 3 made of a refractory material and two rollers 5 and 5'. FIG. 2 is a front view, partly broken away, showing the apparatus of FIG. 1 viewed from the side of the lower level end of the inclined plate 3.

Figure 3A:
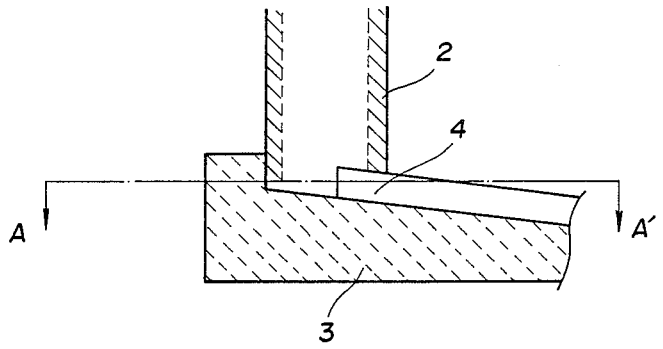
FIG. 3(*a*) is a longitudinal cross-sectional view showing a lower end portion of a nozzle and an inclined plate.
Figure 3B:
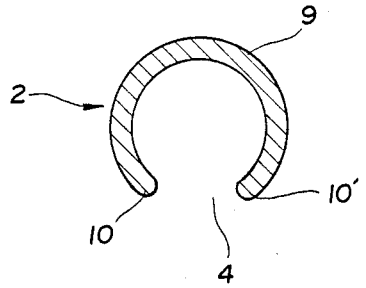

Referring to FIGS. 1 and 2, the lower end of the nozzle 2 is in contact with the inclined top surface of the inclined plate 3 near the high level end thereof. Further, as shown in FIGS. 3(*a*) and 3(*b*), the peripheral wall 9 of the nozzle 2 adjacent to the lower end thereof is formed with a notch 4. The notch 4 faces the lower level end of the inclined plate 3. As shown in FIG. 1, a pair of rollers of internally water cooled type are disposed as the rollers 5 and 5' below the lower level ends 12 of the inclined plate 3. The axes X—X' of rotation of the two rollers 5 and 5' extend parallel to the lower level end 12 of the inclined plate 3.

Molten metal 6 accommodated in the molten metal vessel 1 flows down the nozzle 2 to reach the inclined plate 3 and be re-directed to be discharged from the notch 4 in a fan-shape, as shown in FIG. 2. As the discharged molten metal 6 flows over the inclined surface of the inclined plate 3, it is rendered into a wide laminar flow having a constant shape, which flows down the inclined plate 3.

The constant shape laminar flow reaching the lower level end 12 of the inclined plate 3 is supplied from the lower end level 12 to the open-at-the-top space between the two rollers 5 and 5'. At the opposite ends of the two rollers 5 and 5' dams 11 and 11' are provided such that they are slidable in a direction at right angles to the axes X—X' of rotation of the two rollers 5 and 5'. Thus, the molten metal 6 supplied to the open-at-the-top space noted above forms a molten metal pool 7 in the open-at-the-top space.

According to the present invention, the molten metal 6 may be supplied as a constant shape laminar flow from the lower end 12 of the inclined plate 3 into the open-at-the-top space without generation of any disturbance on the surface of and inside the molten metal pool 7. That is, it is supplied continuously without disturbing the surface and inner part of the molten metal pool 7. As the molten metal pool 7 passes through a gap portion, at which the two rollers 5 and 5' are closest to each other, it is quickly cooled down and solidified to be discharged as a thin metal plate 8 from the open-at-the-bottom space between the two rollers 5 and 5'.

The reason why the wide constant-shape laminar flow may be readily formed according to the present invention will now be described.

The shape of the notch 4 formed at the lower end of the nozzle 2 will now be described in detail with reference to a longitudinal sectional view of FIG. 3(*a*) and also with FIG. 3(*b*) which is a horizontal sectional view taken along line A—A' in Fig. 3(*a*). At the lower end of the nozzle 2, the distance between the opposite ends 10 and 10' of the notch 4 is made equal to or smaller than the inner diameter of the nozzle 2. With this arrangement, the molten metal 16 flowing through the nozzle 2 is never re-directed toward the higher level end of the inclined plate when it is brought into contact with the surface of the inclined plate 3 and redirected to be discharged through the notch 4. The molten metal 6 discharged through the notch 4 flares to be rendered into a wide constant shape laminar flow having a substantially uniform flow rate distribution as it flows down the surface of the inclined plate 3 for a predetermined distance, as is made clear by water model experiments conducted by the inventors as noted above. The constant shape laminar flow which is formed in this way has a substantially uniform thickness over a section taken along a line at right angles to the direction of flow. Further, no substantial waves or other disturbances are recognized over the surface of the constant shape laminar flow.

The nozzle 2 and inclined plate 3 used in accordance with the present invention may be made of such materials as silicon nitride, carbon nitride, alumina, zirconium, mullite, silica and magnesia. The inclined top surface of the inclined plate 3 is a flat surface or a slightly convex or concave surface. The slope of the inclined surface is in a range of 0.5° to 20°, more preferably 1° to 10°. The shape of the end surface of the lower level end 12 of the inclined plate 3 is very important in order that the constant shape laminar flow of the molten metal 6 flowing down the inclined plate 3 be supplied into the molten metal pool 7 in the open-at-the-top space between the two rollers 5 and 5' without any disturbance produced on the surface of or inside the pool 7. Preferably, the lower level end of the inclined plate is recended and will not be touched by the molten metal 6 flowing down.

Figure 4A:
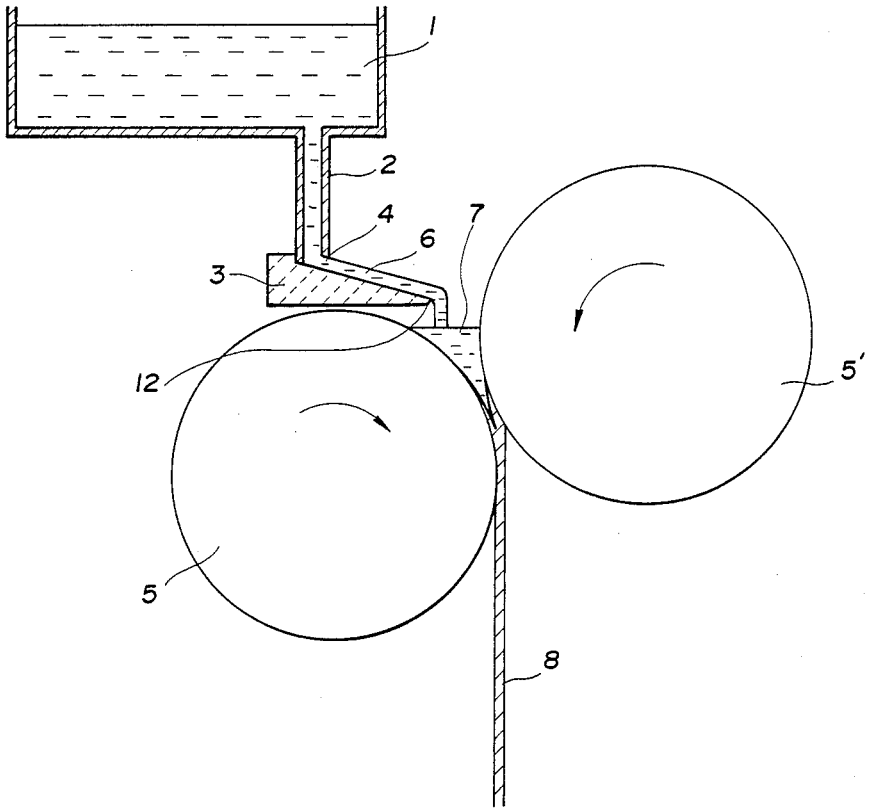
FIG. 4(*a*) is a cross-sectional view showing a pair of rollers disposed at different relative levels, a turndish, a nozzle and an inclined plate according to the present invention.
Figure 4B:
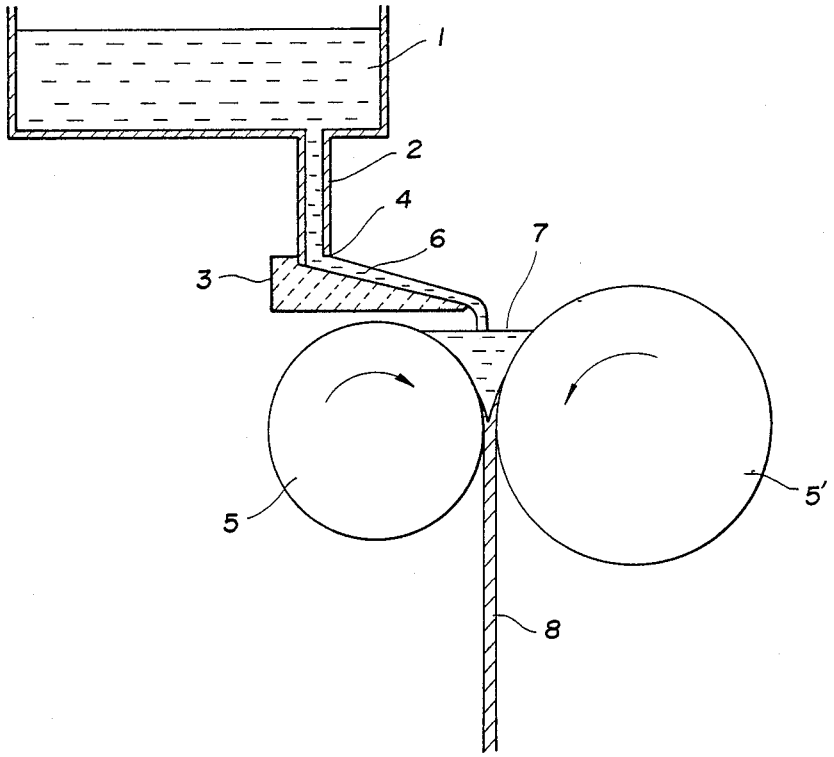

According to the present invention, the axes of rotation of the two rollers 5 and 5' may be at the same level or at different levels. FIG. 4(*a*) shows a case where the axes are at different levels. In this case, the lower level end 12 of the inclined plate 3 may be extremely close to the open-at-the-top space between the two rollers 5 and 5' on the side of the roller 5 which is at the lower level in comparison to the case where the two rollers 5 and 5' at the same level. This arrangement is advantageous in that the disturbance of the molten metal pool 7 may be minimized.

FIG. 4(*b*) shows a case where the two rollers having different diameters are used. The two rollers 5 and 5' are disposed such that their axes of rotation are disposed at the same level. With this arrangement, it is possible to reduce the distance between the lower level end 12 of the inclined plate 3 and the open-at-the-top space between the two rollers 5 and 5'. Thus, it is possible to prevent the disturbance of the molten metal pool 7 by the constant shape laminar flow supplied from the lower level end 12 of the inclined plate 3 to the open-at-the-top space noted above.

Figure 5A:
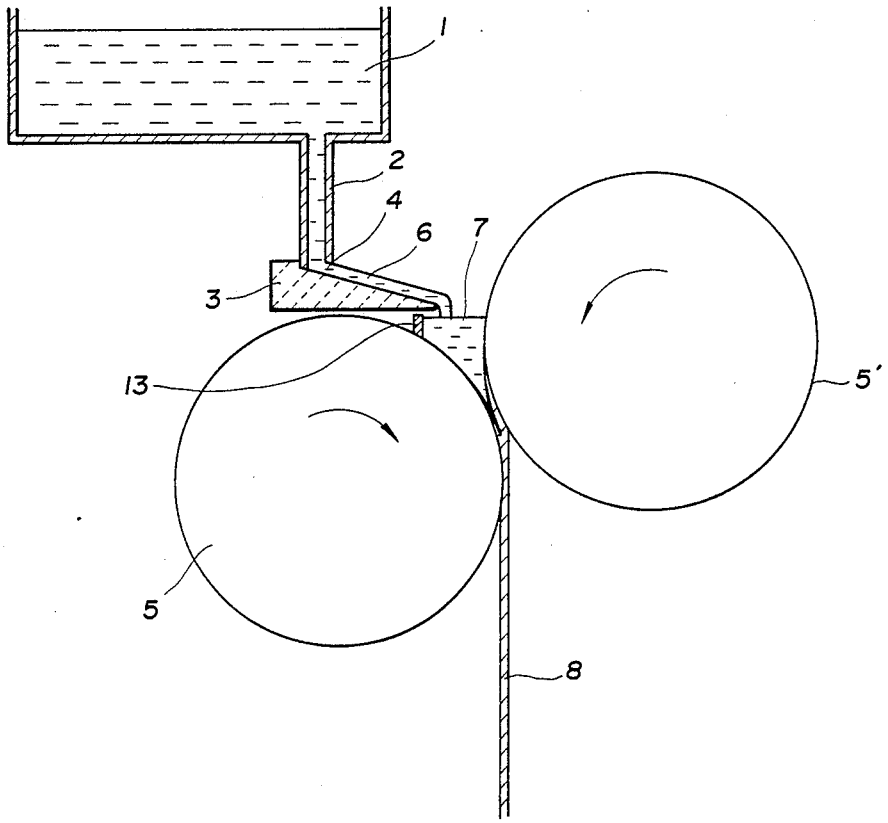
FIGS. 5(*a*) and 5(*b*) are cross-sectional views similar to FIGS. 4(*a*) and 4(*b*), respectively, but showing cases where dams are provided to define an open-at-the-top space between the pair rollers.
Figure 5B:
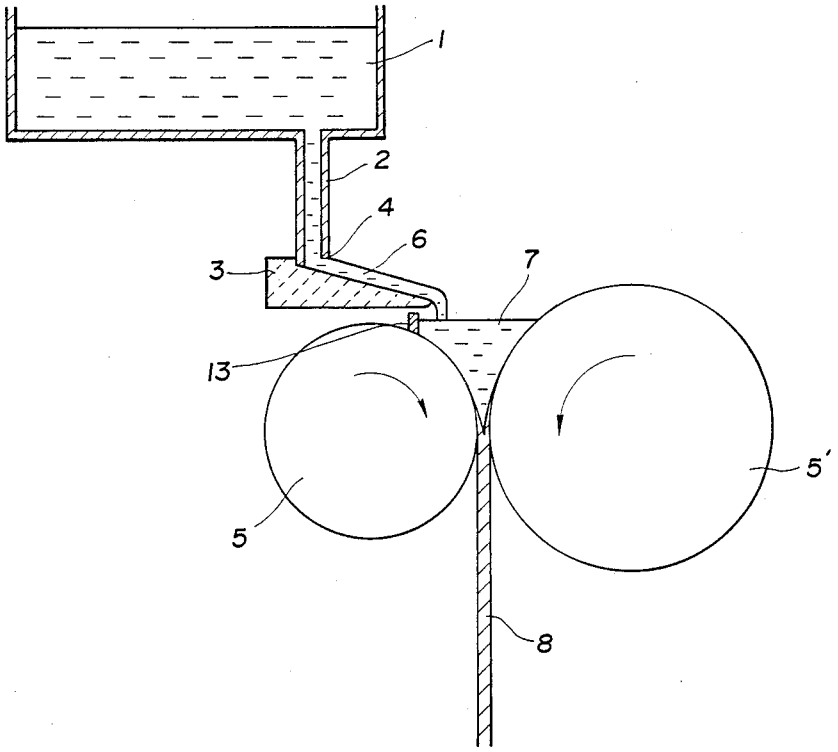

FIG. 5(*a*) is a sectional view showing an arrangement, in which the rollers 5 and 5'0 having the same diameter are disposed with their axes of rotation at the different levels. FIG. 5(*b*) is a sectional view showing an arrangement, in which the rollers having different diameters are disposed with their axes of rotation at the same level. In the arrangement of FIGS. 5(*a*) and 5(*b*), a dam 13 made of a refractory material is provided in contact with the surface of an upper portion of the roller 5. The roller 5 may be rotated in frictional contact with the lower end of the dam 13 so that no molten metal will leak through between the roller and the dam.

The dam 13 is provided for the following reason. When the amount of molten metal in the molten metal pool 7 is small, the level of the molten metal pool is very liable to fluctuate and, as a result, disturbance is liable to be produced on the surface of and inside the molten metal pool 7. By the provision of the dam 13, the amount of molten metal in the molten metal pool 7 may be increased, so that it is possible to minimize the disturbance on the surface of and inside the molten metal pool 7 due to level variations.

According to the present invention the molten metal 6, which is discharged through the notch 4 of the nozzle 2 onto the inclined surface of the inclined plate 3, is influenced by the atmosphere, to which it is exposed, while it flows as the constant shape laminar flow down the inclined surface to be supplied to the open-at-the-top space between the two rollers 5 and 5'. For example, it is contacted by air unless some atmosphere control means is provided. Otherwise, the surface of the constant shape laminar flow is oxidized depending on the kind of metal. Metal oxide which is formed in this way is partly introduced into the molten metal 6 to be present between crystal particles of the thin metal sheet manufactured. In this case, therefore, the surface character of the thin metal sheet is deteriorated as well as mechanical characteristics. When manufacturing a thin metal sheet of a readily oxidizable metal according to the present invention, therefore, it is very advantageous to carry out the process, in which the molten metal 6 is discharged from the notch 4 of the nozzle 2 to reach the open-at-the-top space between the two rollers 5 and 5' and be discharged as the thin metal sheet from the open-at-the-bottom space, in a neutral or reducing atmosphere. In case where the metal concerned may readily absorb $N_2$ in the molten state and various characteristics of its thin sheet are liable to be spoiled by its nitride, the process noted above should be carried out in an atmosphere not containing $N_2$. In this case, it is advantageous to use argon gas.

Further, when manufacturing a thin metal sheet of a metal having a high melting temperature according to the present invention, it is advantageous to provide heat generation means in the inclined plate 3 or suppress temperature fall of the constant shape laminar flow flowing down the inclined plate 3 using a burner, infrared radiation, a laser, etc. in order to maintain a predetermined temperature of the inclined surface of the inclined plate 3 and/or constant shape laminar flow of the molten metal 6.

Further, according to the present invention the molten metal 6 discharged from the notch 4 onto the inclined plate fans into the constant shape laminar flow. It is comparatively ready to make the width of the constant shape laminar flow to be 200 to 500 mm. To form a constant shape laminar flow having a desired greater width to form the wide thin metal sheet from this constant shape laminar flow, two or more nozzles 2 may be provided in a row along a straight line at right angles to the direction of flow of the molten metal over the inclined plate 3. With this arrangement, the thin metal sheet having a desired large width may be manufactured.

According to the present invention, a certain flow-down distance is necessary for the molten metal 6 discharged from the notch 4 in a fan-shape to become the constant shape laminar flow on the inclined surface of the inclined plate 3. This distance depends on the discharge temperature of the molten metal 6, slope of the inclined surface of the inclined plate 3, wetting property of the molten metal 6 and other parameters. According to the present invention, the position, at which the lower end of the nozzle 2 is in contact with the surface of the inclined plate 3, should be such that the discharged molten metal 6 flows down the inclined surface of the inclined plate 3 by a flow-down distance required to become the constant shape laminar flow having a uniform flow rate distribution.

The temperature distribution of the thin metal sheet right after it is discharged from the open-at-the-bottom space between the two rollers in the method according to the present invention in the width direction of the thin metal sheet was examined using a television camera thermosensor monitor, and it was found that the temperature distribution was very uniform at 800° C. In the case of the prior art method, the temperature was greatly fluctuated between 800° C. and 1,150° C., i.e., uniform temperature distribution could not be obtained.

Example

An example of the present invention will now be described.

The following apparatus was used for the manufacture of the thin metal sheet.

| | |
|---|---|
| (1) | Tundish nozzle inner diameter: 10.5 mm<br>Tundish nozzle length: 120 mm<br>Tundish nozzle opening of notch: 120° |
| (2) | Inclined plate material: "zircon" ($ZrSiO_4$)<br>Inclined plate slope of inclined surface: 10° C.<br>Inclined plate length of inclined surface: 50 mm<br>Inclined plate preheating temperature: 1,400° C. |
| (3) | Diameter of a pair of rollers: 400 mmϕ<br>angle between line connecting<br>the axes of two rollers and<br>horizontal line: 40°<br>peripheral speed of rollers: 0.6 m/sec.<br>gap between rollers: 0.5 mm |

Figure 6:
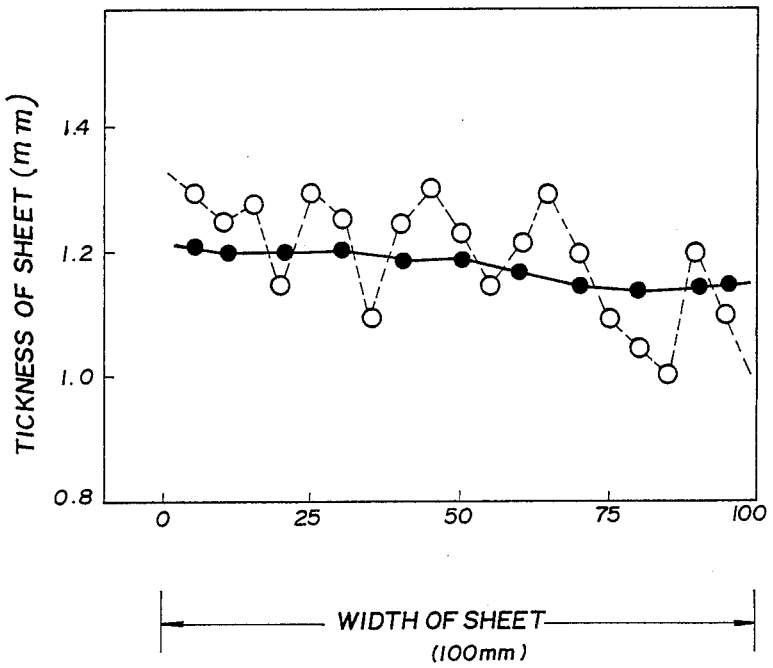
FIG. 6 is a graph showing the relation between the width and the thickness of metal sheets.
Figure 7A:
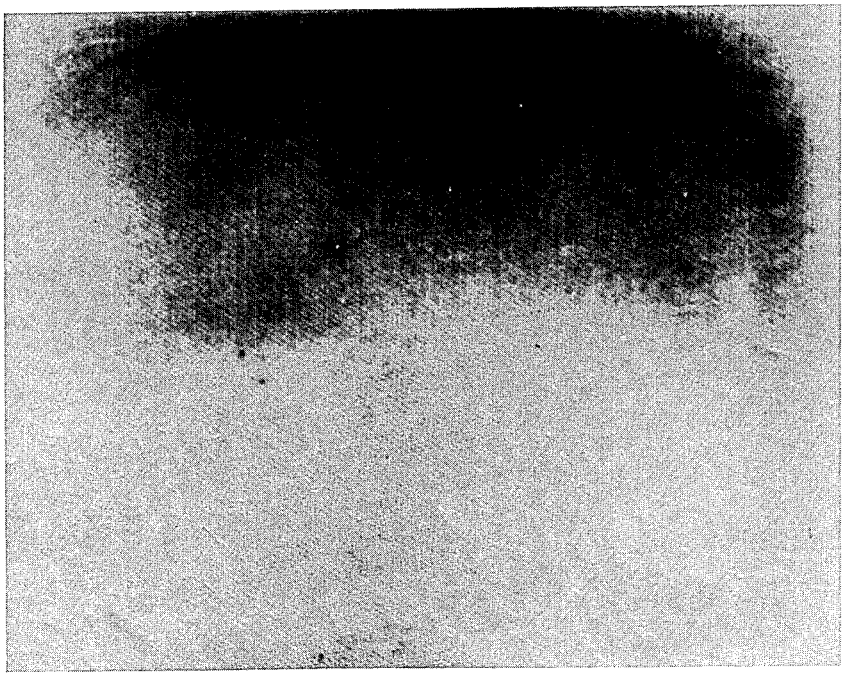
FIGS. 7(*a*) and 7(*b*) are photographs (enlarged to twice the original scale) showing the surface structure of thin metal sheets.
Figure 7B:
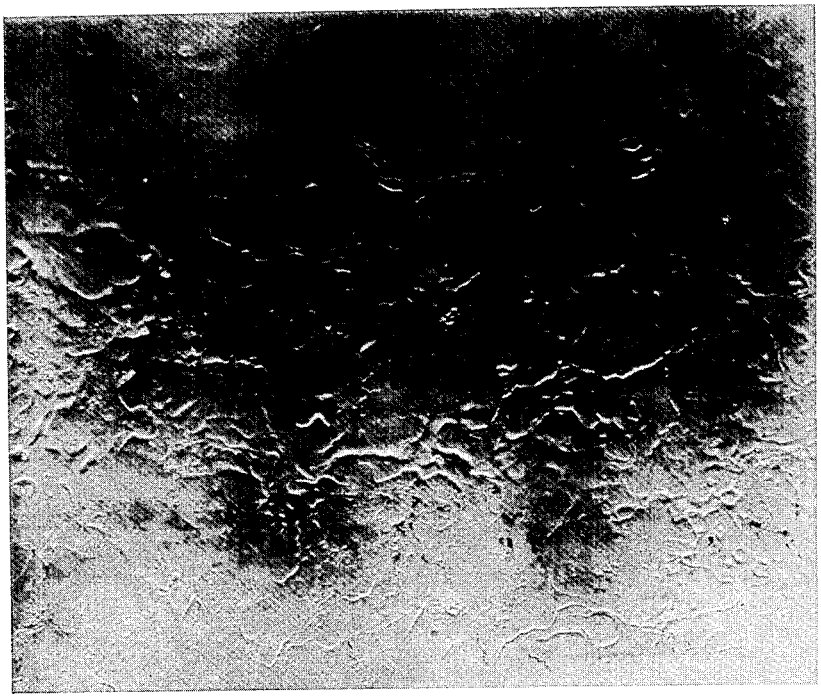
Figure 8A:
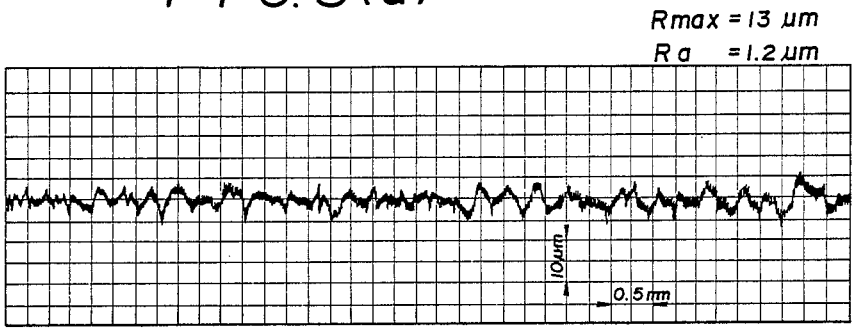
FIGS. 8(*a*) and 8(*b*) are charts showing the maximum surface roughness $R_{max}$ and average surface roughness $R_a$ of the thin metal sheets.
Figure 8B:
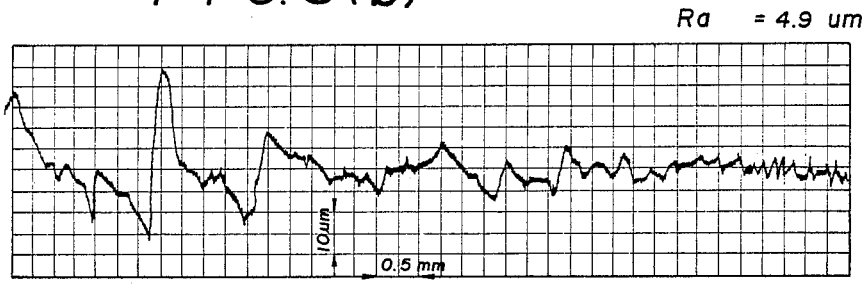

With this apparatus as shown (1), (2) and (3) noted above, the thin metal sheet having a width of 100 mm and a thickness of 1.25 mm could be manufactured from the molten steel of SUS 304 stainless steel. As shown in FIG. 6, the thin metal sheet thus obtained had a satisfactory planar shape compared to the thin metal sheets manufactured by the prior art method. As is seen from FIGS. 7(*a*) and 7(*b*), in the case of the prior art method much wrinkles were recognized as shown in FIG. 7(*b*), whereas according to the present invention very satisfactory surface character substantially free from wrinkles and cracks could be obtained as shown in FIG. 7(*a*). The surface roughness of the thin metal sheet was 13 μm as $R_{max}$ and 1.2 μm as $R_a$ according to the method of the present invention as shown in FIG. 8(*a*) whereas it was 37 μm as $R_{max}$ and 4.90 μm as $R_a$ in the case of the prior art method as shown in FIG. 8(*b*). Accoridng to the present invention very small surface roughness values could be obtained.

As has been described in the foregoing, according to the present invention the following effects could be obtained.

(1) It is possible to obtain satisfactory planar shape free from local thickness fluctuations, and damage to the roller surface may be eliminated.

(2) It is possible to obtain very satisfactory surface character with very little wrinkles and cracks.

(3) The surface roughness values of the thin metal sheet are very small and uniform.

(4) The temperature distribution of the thin metal sheet immediately after discharging from between the two rollers over the width direction at high temperature is uniform, so that it is possible to eliminate formation of cracks after cooling.

(5) The thin metal sheet manufactured in accordance with the present invention may be cold rolled without annealing. The cold rolled metal sheet obtained in this way has very superior surface characters to those in the case of the prior art method.

(6) The thin metal sheet obtainable has a homogenious character both on the surface and in the inside. Therefore, it is possible to eliminate fluctuations of mechanical characteristics, corrosion-proof property and other characters of the product.

(7) Even when casting the wide thin metal sheet at a high speed, there is no need of usng any slit-like nozzle. It is thus possible to eliminate clogging of the nozzle and disturbance of the flow. Thus, it is possible to manufacture the thin metal sheet having high viscosity, for instance. That is, according to the present invention it is possible to manufacture a wide variety of the thin metal sheets.

(8) It is possible to manufacture the wide thin metal sheet having a uniform width by usng an increased number of nozzles.

According to the present invention, it is possible to manufacture the thin metal sheets having satisfactory surface character economically and on a mass production basis compared to the prior art casting-rolling method and prior art pair of rollers method with a simple apparatus and by a simple operation. The present invention is thus extremely industrially variable.

What is claimed is:

1. A method of manufacturing a wide thin metal sheet directly from molten metal, comprising the steps of:

melting the metal to form a pool;

channeling a flow of molten metal in a vertical direction;

discharging said molten metal in a fan-shaped pattern along a downwardly inclined direction on an inclined plate;

maintaining said discharged molten metal in a constant fan-shaped flow having a uniform flow rate;

directing said fan-shaped flow to a molten metal flow space having a restricted passage;

depositing said fan-shaped flow, from above, into said molten metal flow space without causing a disturbance on the surface of the molten metal by feeding the molten metal from the plate from an outlet positioned above a molten pool;

applying rotational forces to said molten metal in said flow space; and simultaneously cooling and solidifying said molten metal passing through said flow space and said rotational forces.

2. A method of manufacturing a wide thin metal sheet directly from molten metal according to claim 1, wherein said inclined direction is defined by a flat surface or a gently convex or concave surface.

3. A method of manufacturing a wide thin metal sheet directly from molten metal according to claim 1, wherein axes of rotation forces are at the same level or at different levels.

4. A method of manufacturing a wide thin metal sheet directly from molten metal according to claim 1, wherein said rotational forces are defined by a pair of rollers having an equal diameter or different diameters.

5. A method of manufacturing a wide thin metal sheet directly from molten metal according to claim 1, wherein said fan-shaped flow is obtained with one or more nozzles.

6. An apparatus for manufacturing a wide thin metal sheet directly from molten metal comprising:

a nozzle installed vertically at the bottom of a molten metal vessel;

an inclined generally planar plate in contact with the lower end of said nozzle;

a pair of rollers of internally water cooled type and having axes of rotation extending substantially parallel to and below the lower level end of said inclined plate;

a pair of dams provided at the opposite ends of said pair of rollers and slidable in a direction at right angles to the direction of said axes of rotation of said pair of rollers;

the peripheral wall of the lower end of said nozzle being formed with a notch facing the lower level end of said inclined plate, with the notch being directed generally perpendicular to said axes of rotation of the rollers;

the distance between a position of contact between the lower end of said nozzle and said inclined surface and said lower level end of said inclined plate being determined by the angularity of said inclined plate to provide a constant fanshape laminar flow having a uniform flow rate distribution on said inclined surface as it flows down said inclined surface;

the lower level end of said inclined plate being positioned downstream of the notch above a molten metal pool defined between the rollers and said dams so that the molten metal falling from said lower level end of said inclined plate will not cause any disturbance on the surface of or the inside of said molten metal pool; and said molten metal being solidified in the narrower gap portion between said pair of rollers to be discharged from saide open-at-the-bottom space between said pair of rollers.

7. An apparatus for manufacturing a wide thin metal sheet directly from molten metal according to claim 6, wherein said inclined surface is a flat surface or a gently convex or concave surface.

8. An apparatus for manufacturing a wide thin metal sheet directly from molten metal according to claim 6, wherein the axes of rotation of said pair of rollers are at the same level or at different levels.

9. An apparatus for manufacturing a wide thin metal sheet directly from molten metal according to claim 6, wherein said pair of rollers have an equal diameter or different diameters.

10. An apparatus for manufacturing a wide thin metal sheet directly from molten metal according to claim 6, wherein the end surface of said lower level end of said inclined plate has a lower portion receding with respect to the perpendicular direction.

11. An apparatus for manufacturing a wide thin metal sheet directly from molten metal according to claim 6, wherein one or more nozzles are used as said nozzle.

12. An apparatus for manufacturing a wide thin metal sheet directly from molten metal comprising:

a nozzle installed vertically at the bottom of a molten metal vessel;

an inclined generally planar plate in contact with the lower end of said nozzle;

a pair of rollers of internally water cooled type and having axes of rotation extending substantially parallel to and below the lower level end of said inclined plate, said axes of rotation being at different levels;

a pair of dams provided at the opposite ends of said pair of rollers and slidable in a direction at right angles to the direction of said axes of rotation of said pair of rollers;

a dam provided in the neighborhood of the highest level portion of the rotating surface of one of said pair of rollers with the axes of rotation at the lower level, said dam extending parallel to the direction of said axes of rotation and having opposite ends in contact with said opposite end dams;

the peripheral wall of the lower end of said nozzle being formed with a notch facing the lower level end of said inclined plate, with the notch being directly generally perpendicular to said axes of rotation of the rollers;

the distance between a position of contact between the lower end of said nozzle and said inclined surface and said lower level end of said inclined plate being determined by the angularity of said inclined plate to provide a constant shape laminar flow having a uniform flow rate distribution on said inclined surface as it flows down said inclined surface;

an outlet end of said inclined plate being positioned downstream of the notch above a molten pool defined between the rollers and said dams so that the molten metal falling from said outlet end of said inclined plate into the molten pool below will not cause any disturbance on the surface of or the inside of said molten metal pool; and said molten metal being solidified in the narrowest gap portion between said pair of rollers to be discharged from said open-at-the-bottom space between said pair of rollers.

* * * * *